United States Patent [19]

Farmer et al.

[11] 4,316,628

[45] Feb. 23, 1982

[54] SUCTION PADS FOR SUPPORTING LOADS

[75] Inventors: Rodney C. Farmer; Hugh A. Goldsmith, both of Bristol; Michael J. Proudlove, Congleton, all of England

[73] Assignee: Nuclear Power Company Limited, London, England

[21] Appl. No.: 170,629

[22] Filed: Jul. 21, 1980

[30] Foreign Application Priority Data

Jul. 25, 1979 [GB] United Kingdom ..... 25984/79

[51] Int. Cl.[3] ..... B66C 1/02

[52] U.S. Cl. ..... 294/64 R

[58] Field of Search ..... 294/64 R, 64 A, 64 B, 294/65; 248/363; 271/108, 232, 258; 269/21

[56] References Cited

U.S. PATENT DOCUMENTS 3,602,543 8/1971 Sjodin ..... 294/64 R 3,841,687 10/1974 Banyas et al. ..... 294/64 R

*Primary Examiner*—James B. Marbert

*Attorney, Agent, or Firm*—William R. Hinds

[57] ABSTRACT

A suction pad for adhering a load to a surface and comprising a disc having an extensible annular seal on one face and a radial vacuum inducer mounted on the other. The inducer is capable of evacuating the interior region bounded by the seal to anchor the disc to the surface. There are gas thrusters disposed outside the seal for opposing the vacuum by extending the seal when it is required to reduce adhesion to allow lateral displacement of the suction pad without breaking the annular seal.

6 Claims, 6 Drawing Figures

SUCTION PADS FOR SUPPORTING LOADS

BACKGROUND OF THE INVENTION

This invention relates to suction pads for supporting loads.

An object of the invention is to provide a suction pad for adapting a load to be either anchored to or to be slidably supported from an inclined or inverted surface.

SUMMARY OF THE INVENTION

According to the invention a suction pad for adapting a load to be slidably supported from an inclined or inverted surface comprises a disc having an extensible face seal for bounding an evacuable void between the disc and surface, suction means for evacuating the void and fluid thrust means arranged to operate in opposition to the suction means and operable selectively to lift the disc relative to the surface by extending the seal without breaking the seal. A suction pad according to the invention when attached to a load enables the load to be supported from an inclined or inverted surface by suction in two operational modes: firstly, by clamping the disc firmly to the surface by suction the load is securely anchored and secondly, by using the fluid thrust means to oppose the suction means the disc may be lifted relative to the surface whilst maintaining adherence of the pad thereby facilitating lateral sliding displacement of the pad and load relative to the surface.

DESCRIPTION OF THE DRAWINGS

A suction pad embodying the invention is described by way of example, with reference to the accompanying drawings wherein.

DESCRIPTION OF THE PREFERRED EMBODIMENT

Figure 1:
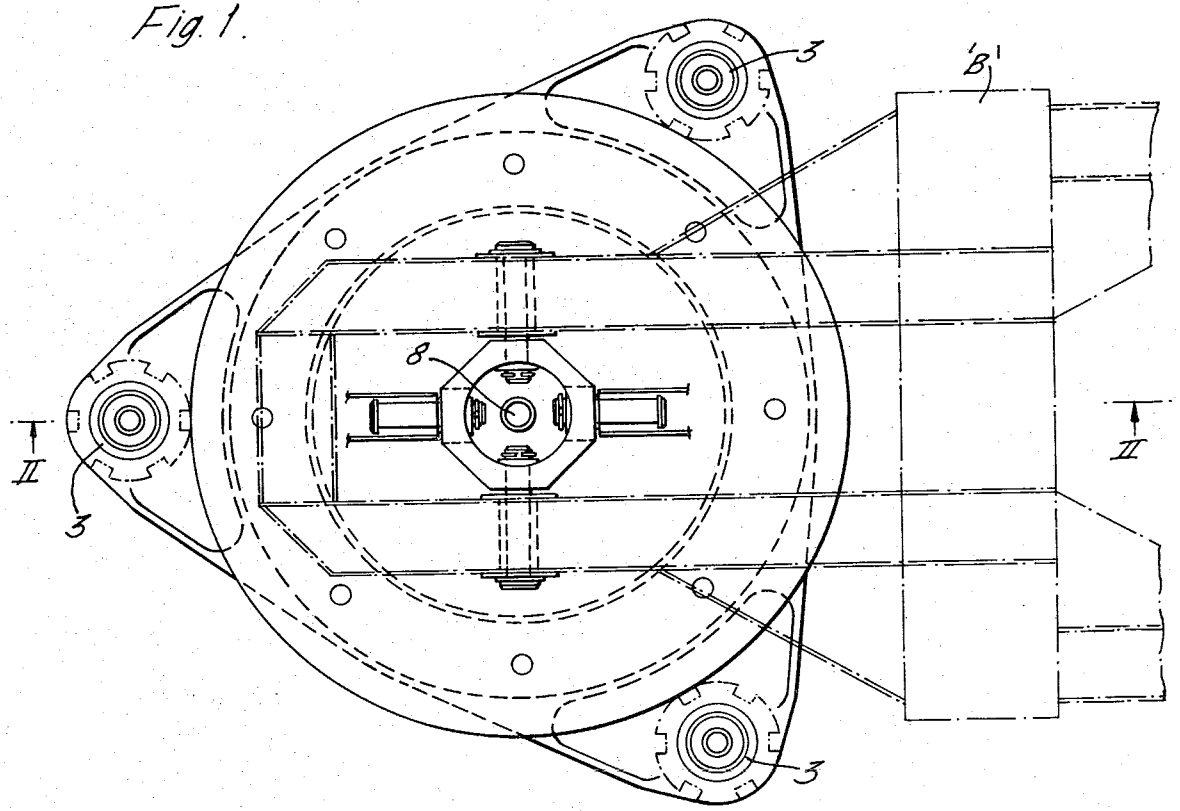
FIG. 1 is a plan view.
Figure 2:
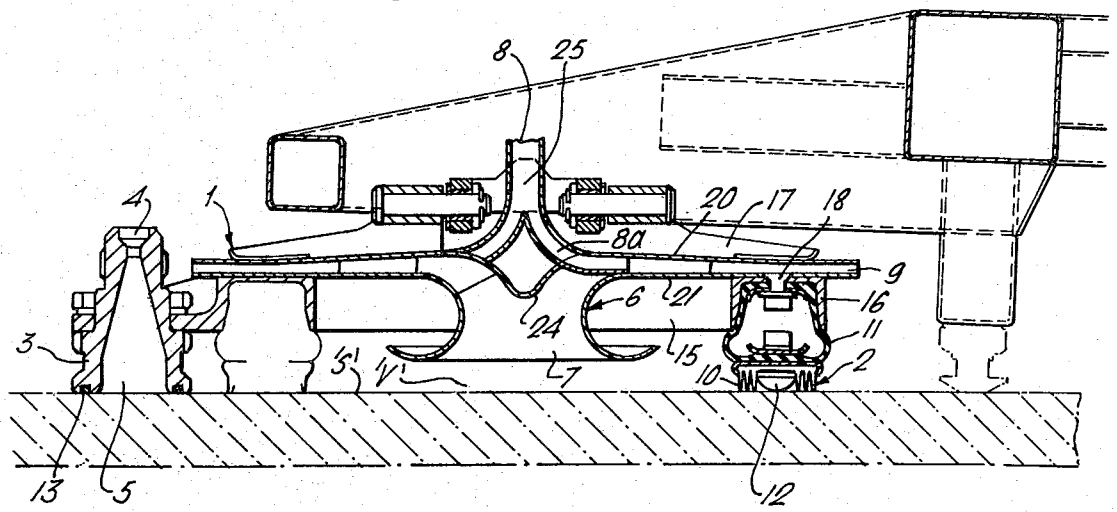
FIG. 2 is sectional end view on line II—II of FIG. 1.
Figure 6:
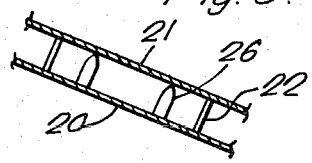
FIG. 6 is a sectional view on line VI—VI of FIG. 4.
Figure 5:
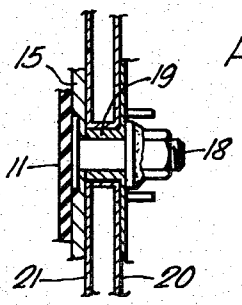
FIG. 5 is a side view in section on line V—V of FIG. 4.
Figure 3:
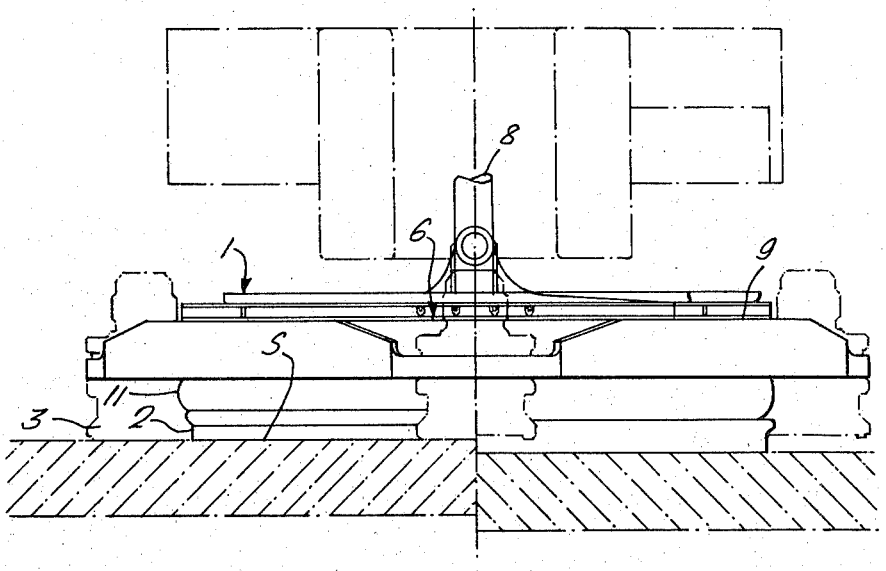
FIG. 3 is an end elevation.

With reference to FIGS. 1 and 2 the suction pad comprises a load or vehicle supporting disc 1 having an expansible annual seal member 2 on its underside which, in cooperation with a support surface 'S', bounds a central void 'V'. Disposed outside the sealing member 2 there are three fluid thrusters 3 which penetrate the disc and have upper entry ports 4 for pressurised gas and mouths 5 providing exit ports for gas to underside of the disc. The disc carries suction means in the form of a jet pump suction device 6 of the radial vacuum inducer kind which has a flared suction port 7 disposed within the void 'V', a central gas pressure port 8 on the upper face of the disc and a peripheral exit port 9.

In use of the suction pad the load can be held firmly to the support surface by evacuating the void 'V' by means of the jet pump suction device 6 whereby the disc is clamped to the surface. For enabling lateral displacement of the load, the disc is lifted off the surface by means of the fluid thrusters the movement of the disc relative to the seal being accommodated by a resiliently deformable member 11 so that the suction effort is maintained to continue support of the load.

In greater detail the suction pad is one of a pair of pads disposed one at each end of a bridge (designated B and shown in broken line in FIGS. 1 and 2) constituting a vehicle for carrying non destructive test instrumentation for inspecting a large vessel used for containing a nuclear reactor fuel assembly submerged in liquid metal coolant. The vehicle is the subject of a co-pending application entitled non-destructive test apparatus by E A Hyde, H A Goldsmith and M J Proudlove and filed on the same day as the present application. Each pad is gimbal mounted with four alignment springs 14 (shown in FIG. 4) interposed between the foot pad and the bridge so that the foot pad will adapt to the curved surfaces of the vessel.

Each sealing member 2 has a series of concentric lips 10 of synthetic rubber providing a labyrinth seal and is mounted on a resiliently deformable member 11. An annual series of bearing pads 12 of low friction material comprising polytetrafluoroethylene containing 15% glass filling is disposed concentrically between inner and outer lips of the seal member.

The resiliently deformable member 11 urges the lips 10 of the labyrinth seal into contact with the surface 'S' and thereby supports the depression in the void by dropping the pressure progressively across the lips of the seal. The bearing pads 12 serve to limit the deflection of the sealing lips and the resiliently deformable member also ensures that the lips of the labyrinth seal remain in sealing contact with the surface whilst the disc is lifted off by the fluid thrusters thereby maintaining equilibrium vacuum within the void when external forces tend to increase the lift-off of the foot pad from the surface. The interface between the seal and deformable member is made relatively stiff to resist "roll-over" effect on the seal assembly due to pressure differential across it.

The fluid thrusters each have a choke and an expansion chamber which diverges towards the mouth and a high friction elastomeric ring 13 disposed at the end about the mouth for abutment with the surface.

In use, pressurised gas flows through the choke at supersonic speed and expands within the chamber to subsonic speed to thrust against the surface and achieve lift-off of the disc. When a design lift-off compatible with expansion of the seal member 2 is achieved a state of equilibrium is reached so that the lift-off height remains substantially constant. The rings 13 resist sliding of the vehicle due to its weight when the pads are adhering to an inclined surface of the vessel.

Referring now to FIGS. 2, 3, 4, 5 and 6 the suction pad has a frame 15 comprising an annular channel 16 which houses the resiliently deformable member 11. The frame is surmounted by a trunnion disc 17 with the jet pump 6 interposed therebetween the assembly being secured together by set bolts 18 with tubular spacers 19 shown in FIG. 5.

Figure 4:
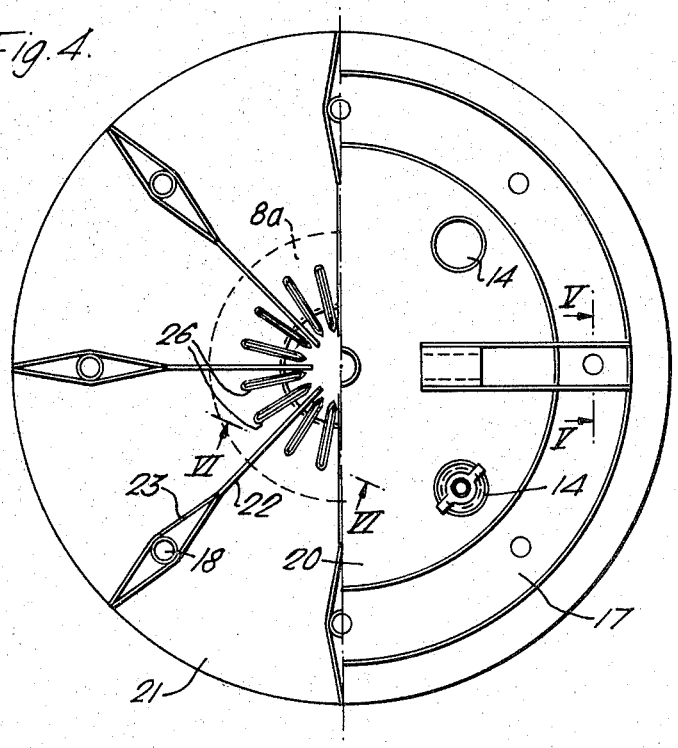
FIG. 4 is plan view of an inducer assembly, the left hand side showing the inducer with the outer shroud removed.

The jet pump 6 comprises upper and lower discs 20, 21 spaced apart by the spacers 19 and has radial ribs 22 with flow deflectors 23 enshrouding the shanks of the set bolts 18 as shown in FIG. 4. The lower disc 21 is formed with the central flared suction port 7 whilst the upper disc 20 is formed to provide a central fairing 24 for conducting the air flow radially outwardly to the peripheral exit port of the jet pump. The upper disc carries a primary gas duct 25 comprising the central gas port 8 which is tubular and has an annular manifold 8*a*.

A series of elongate subordinate ducts 26 attached to the upper disc 20 within the interspace between the discs extends radially towards the peripheral exit port and are fed from the primary duct 25 by way of slits in the upper disc. In use pressurised gas flows through the elongate subordinate ducts induce air flow from the eye of the jet pump 6 thereby effecting a depression in the void. Suction means of the radial inducer fluid carried by the pads avoids the need for large ducts extending from a vacuum source and, because the jet pump exhausts radially it produces no lateral thrust which could cause lateral displacement of the suction pad.

We claim:

1. A suction pad for supporting a load in a selectively slidable state from a supporting surface, comprising:

a disc (1);

an annular deformable face seal (2) spaced from said disc for sealingly engaging a surface;

an extensible ring (11) between said disc and said face seal permitting the disc and seal to be moved towards and away from each other and defining an evacuable void (V) when the face seal engages a surface;

suction means (6) energisable to evacuate said void; and fluid thrust means (3) on said disc for contacting said surface and selectively independently energisable to exert an upward thrust on said disc and effect escape of fluid between the thrust means and the surface; the arrangement being such that with the suction means energised and the thrust means not energised the pad clings with high lateral adhesion to said surface, and with the suction means still energised and the thrust means also energised the pad clings to said surface with low lateral adhesion.

2. The combination as claimed in claim 1 in which said face seal includes a low friction bearing member (12) which bears on said surface when the face seal deforms as the pad clings to the surface.

3. The combination as claimed in claim 2 in which the thrust means has a high friction ring (13) at the point where the thrust means contacts the surface.

4. The combination as claimed in claim 1 in which said face seal has a series of concentric annular lips (10) to provide a labyrinth seal with said surface.

5. The combination as claimed in claim 1 in which said suction means (6) comprises a jet pump of the radial vacuum inducer kind.

6. In combination with a surface of a body, a suction pad comprising a disc; an annular deformable face seal having concentric annular sealing lips below and spaced from said disc; an extensible ring between said disc and said face seal permitting the disc and the seal to move towards and away from each other and defining with the disc and said surface an evacuable void; suction means having means defining an opening penetrating said disc for evaluating said void; fluid thrust means on said disc and contacting said surface by means providing lateral adherence, the thrust means being energisable to exert an upward thrust on said disc without breaking the suction seal and at the same time to cause fluid to pass between said means providing lateral adherence and said surface whereby said lateral adherence is substantially destroyed; and a low friction bearing member located concentrically with said concentric annular sealing lips and bearing on said surface.

* * * * *